US011753827B2

(12) United States Patent
Espinosa

(10) Patent No.: US 11,753,827 B2
(45) Date of Patent: Sep. 12, 2023

(54) DEVICE FOR CLEANING GUTTERS

(71) Applicant: Francisco J. Espinosa, Matthews, NC (US)

(72) Inventor: Francisco J. Espinosa, Matthews, NC (US)

( * ) Notice: Subject to any disclaimer, the term of this patent is extended or adjusted under 35 U.S.C. 154(b) by 282 days.

(21) Appl. No.: 17/399,075

(22) Filed: Aug. 11, 2021

(65) Prior Publication Data

US 2023/0048121 A1 Feb. 16, 2023

(51) Int. Cl.
*E04D 13/076* (2006.01)
*B08B 9/00* (2006.01)

(52) U.S. Cl.
CPC ..... *E04D 13/0765* (2013.01); *B08B 9/00* (2013.01)

(58) Field of Classification Search
CPC ..... E04D 13/0765; B08B 9/00
See application file for complete search history.

(56) References Cited

U.S. PATENT DOCUMENTS 2,299,418 A 10/1942 Thomas
4,298,224 A 11/1981 Hansen et al.
D267,357 S 12/1982 Hillstrom
4,447,927 A 5/1984 Malless, Jr.
4,640,540 A 2/1987 Chisholm
4,848,818 A 7/1989 Smith
D310,590 S 9/1990 Williams, Jr.
D318,350 S 7/1991 Muffuletto
D374,319 S 10/1996 Schildgen
6,412,842 B1 7/2002 Winston
6,925,676 B2 8/2005 Heavner et al.
7,260,866 B2 8/2007 Hubbard
7,891,040 B2 2/2011 Christie
D809,233 S 1/2018 Opry et al.

*Primary Examiner* — Andrew A Horton
(74) *Attorney, Agent, or Firm* — Memminger E. Wiggins

(57) ABSTRACT

The present invention provides a device for cleaning gutters. The design and configuration of the device's angular side walls and the angles of the sloped upper edges of the angular sides result in a more effective and efficient removal of accumulated gutter debris. The present invention comprising a rectangular bottom, first and second angular side walls, a vertical trapezoidal rear wall, and an elongated tubular handle, wherein such features defining a scoop-like device designed and adapted to receive and remove accumulated debris from a gutter. Each of the angular side walls comprising respective top edges with each top edge comprising a plurality of respective sloped upper edges and respective horizontal edges.

15 Claims, 8 Drawing Sheets

DEVICE FOR CLEANING GUTTERS

FIELD OF THE INVENTION

The present invention, a device for cleaning gutters, relates to hand-held tools for removing accumulated debris from gutters, and more particularly to a device that is designed and configured to effectively engage the interior angles of a gutter for a more efficient removal of gutter debris.

BACKGROUND OF THE INVENTION

Diverting rainwater away from a building, be it a residential building or a commercial building, is desired to prevent possible damage and/or deterioration to a building's foundation, the flooding of a building's basement, and well as hazards associated with the pooling and accumulation of surface water in the immediate proximity of a building. One of the most common methods used to address such rainwater issues is the installation of a gutter and downspout system at a building's roof edge. Unfortunately, leaves, pine needles, twigs, small branches and limbs, dirt, shingle sand material, and such other debris may accumulate within a gutter and thereby negatively impacting the effectiveness of the gutter and downspout system.

Additionally, accumulated debris within a gutter can become compacted over time which makes its removal even more difficult and problematic. A gutter clogged with debris can interrupt the flow of rainwater within the gutter and downspout system which in turn can result with the rainwater flowing over the gutter top and down to those areas immediately adjacent to a building's wall or foundation. Additionally, there is also a possibility that the weight of the rainwater pooled within the gutter may cause the gutter, and also the facia or other surface to which the gutter is attached, to pull away from the building and thereby result in damage to the building at its roof edge due in part to the gutter fasteners failing to release from the gutter or facia surface.

Although various systems and scoop-like devices are currently available to address the problems associated with the accumulation of debris within gutters, limitations to their utilization and effectiveness still exist. Various gutter coverings have been developed which aim to prevent possible debris from entering a gutter all together, but such coverings can be expensive, difficult to install, difficult to adapt to the various sizes of gutters, and perhaps not as effective as may be desired by the building owner. Gutters are manufactured in a variety of sizes and with a variety of internal dimensions and shapes. Additionally, most gutters have braces to maintain the gutter wall integrity and are customarily fastened to a building's roof edge with various types of fasteners such as spikes, ferrules, and clips. These gutter braces and gutter fasteners often interfere with most scoop-like gutter cleaning devices due to the shape, size, and design of such gutter cleaning devices. Another problem often incurred when cleaning gutters is due to shingle overhang at the roof's edge which interferes with accessing a gutter's internal area. Shingle overhang can become even more problematic when new roofing is installed over the current roofing which generally increases the amount of shingle overhang. The shape, size, and design of common garden scoops, as well as the specifically designed scoop-like gutter cleaning devices, often have difficulty in accessing the confined internal area of a gutter or being able to address the internal shape of a gutter's interior to effectively remove gutter debris. Also, the shape and design of the generic garden scoop, and some of the specifically designed scoop-like gutter cleaning devices, are not designed to effectively remove accumulated gutter debris that has become compacted over time.

Accordingly, there remains room for improvement and variation within the art and a need for a simple and effective device for removing debris from gutters.

SUMMARY OF THE INVENTION

The present invention is directed to a device for the removal of debris which has accumulated within a gutter and thus interfering with the flow of rainwater within the gutter and generally to a gutter downspout. At least one preferred embodiment for the present invention includes a scoop-like device having appropriately sized opposing first and second angular side walls with each angular side wall having a front sloped portion comprising a plurality of sloped upper edges. The simple design and configuration of the present invention allows for its one-handed use and permits access and maneuverability into and within the confines of the walls of a gutter for the efficient removal of gutter debris while minimizing risk of injury to a user's hand, fingers, and/or knuckles during use. Additionally, the size and the sloped upper edges of the first and second angular side walls of the present invention enables a user to rotate the present invention such that an appropriately sloped upper edge of an angular side wall can engage the interior slope of a gutter wall for a more efficient removal of gutter debris.

Therefore, it is at least one aspect of the present embodiments of the present invention to provide a hand-held device for cleaning gutters which comprises a rectangular bottom, a first angular side wall, a second angular side wall, a vertical trapezoidal rear wall, and an elongated tubular handle that extends outwardly away from the vertical trapezoidal rear wall.

It is a further aspect of at least one of the present embodiments to provide a rectangular bottom which has a beveled front edge, a first bottom edge, a second bottom edge, and a rear bottom edge.

It is another aspect of at least one of the present embodiments of the present invention to provide a first angular side wall that extends upward from the first bottom edge of the rectangular bottom at a first outward angle of about 7 degrees. The first angular side wall includes a first sloped upper edge with a first upward angle of about 35 degrees, a second sloped upper edge with a second upward angle of about 25 degrees, a first horizontal upper edge, and a first rear edge.

It is another aspect of at least one of the present embodiments of the present invention to provide a second angular side wall that extends upward from the second bottom edge of the rectangular bottom at a second outward angle of about 7 degrees. The second angular side wall includes a third sloped upper edge with a third upward angle of about 35 degrees, a fourth sloped upper edge with a fourth upward angle of about 25 degrees, a second horizontal upper edge, and a second rear edge.

It is still a further aspect for one preferred embodiment of the present invention to provide a vertical trapezoidal rear wall that extends perpendicularly upward from the rear bottom edge of the rectangular bottom. The vertical trapezoidal rear wall includes a rear top edge, first and second angled edges that extend outward at first and second outward angles of about 7 degrees.

It is at least one aspect of the present embodiments for the present invention for provide an elongated tubular handle that is centrally upward affixed to, and extends horizontally outward from, the outer surface of the vertical trapezoidal rear wall.

Another aspect of at least one preferred embodiment of the present invention is to provide a gutter cleaning device with angular side wall that can accommodate, compliment, and engage the interior outward angle of a gutter wall.

It is another aspect of at least one of the present embodiments of the present invention to provide a gutter cleaning device with sloped upper edges that can engage a gutter's interior wall angles.

It is a further aspect of at least one of the present embodiments for the present invention to provide a gutter cleaning device with a beveled front edge that can facilitate the removal of compacted or dried gutter debris.

Another aspect of at least one preferred embodiment of the present invention is to provide a gutter cleaning device that can retain gutter debris within its walls during use and on removal of such debris.

Another aspect of at least one preferred embodiment of the present invention is to provide a gutter cleaning device that provides for one-handed use.

It is still a further aspect for one preferred embodiment of the present invention to provide a gutter cleaning device that can easily access the interior of a gutter.

It is another aspect of at least one of the present embodiments of the present invention to provide a gutter cleaning device that provides for maneuverability within the interior walls of a gutter.

It is still a further aspect for one preferred embodiment of the present invention to provide a gutter cleaning device that minimizes injury to a user's hand, fingers, and knuckles.

These and other features, aspects, and advantages of the present invention will become better understood with regard to the following description, appended claims, and accompanying drawings.

DETAILED DESCRIPTION OF THE INVENTION

Figure 1:
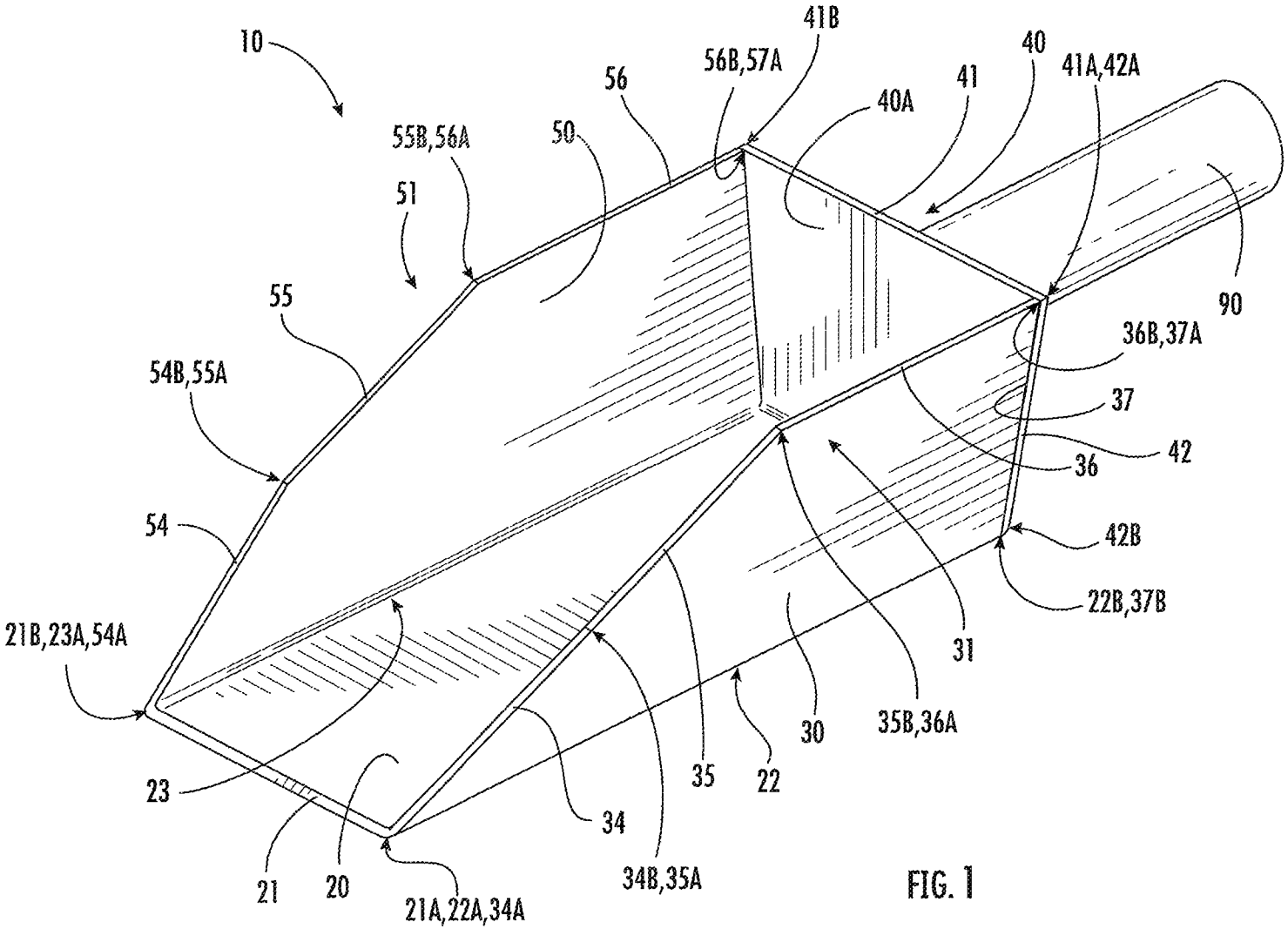
FIG. 1 is a front left perspective view of a preferred embodiment for the present invention.

Prior to referring to the drawings, definitions and explanations are offered to assist the reader in understanding this description.

The singular forms "a", "an" and "the" are intended to include the plural forms as well, unless the context clearly indicates otherwise. It will be further understood that the terms "having", "including", "comprises" and/or "comprising" when used in this specification, specify the presence of stated features, integers, steps, operations, elements, and/or components, but do not preclude the presence or addition of one or more other features, integers, steps, operations, elements, components, and/or groups thereof.

In the description of exemplary embodiments, relative terms such as "angled", "upper", "lower", "upward", "downward", "forward", "rearward", "inward", "outward", "left", "leftward", "right", "rightward", "middle", "midway", "contiguous", "parallel", "coplanar", "horizontal", "vertical", "lateral", "above", "below", "up", "down", "top", "bottom", "front", and "back" as well as derivatives thereof (e.g., "horizontally", "downwardly", "upwardly", "inwardly", "outwardly", "vertically", "perpendicularly") should be construed to refer to the orientation as then described or as shown in the drawing under the discussion.

In describing specific aspects, components, or elements of the present invention when such aspect, component, or element is referred to herein as being attached, contiguous, connected, coupled, or fastened to another aspect, component, or element, it can be directly attached, contiguous, connected, coupled, or fastened to the to the other aspect, component, or element or intervening elements that may be present. In contrast, when an aspect, component, or element is referred to herein as being directly attached, contiguous, connected, coupled, or fastened to another aspect, component, or element, there are no intervening aspect, components, or elements present. Moreover, although the drawings illustrate connection of some aspects, components, or elements by means of welding, any other connecting, fastening, or bonding means may be used provided such means does not interfere with the operation or structural integrity of the subject device.

Reference will now be made in detail to one exemplary embodiment of the present invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the intended invention. Other objects, features, and aspects of the present invention are disclosed in the following detailed description. It is to be understood by one of ordinary skill in the art that the present discussion is a description of one exemplary embodiment only and is not intended as limiting the broader aspects of the present invention.

In describing the various figures herein, the same reference numbers are used throughout to describe the same aspect, apparatus, component, element, or process pathway as applicable. To avoid redundancy, detailed descriptions of much of the apparatus once described in relation to a figure is not necessarily repeated in the descriptions of subsequent figures, although such apparatus or aspect or component or process is labeled with the same reference numbers.

A device for cleaning gutters according to a preferred embodiment of the present inventions is illustrated in FIGS. 1 to 11. One exemplary embodiment of the present invention 10 can be generally described as a device for cleaning gutters comprising a rectangular bottom 20, a first angular side wall 30, a second angular side wall 50, a vertical trapezoidal rear wall 40, and an elongated tubular handle 90, wherein such features defining a scoop-like device designed and adapted to receive and remove accumulated debris from the interior of a gutter.

Figure 5A:
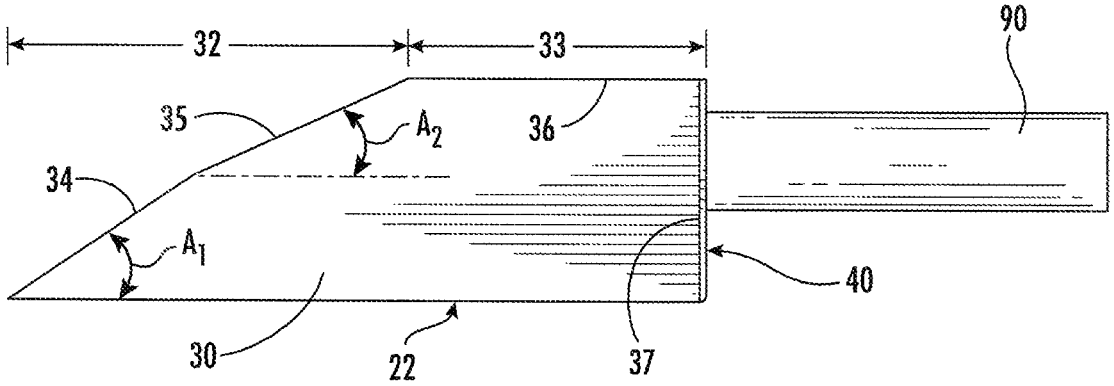
FIG. 5A is left side view of a preferred embodiment for the present invention.
Figure 5B:
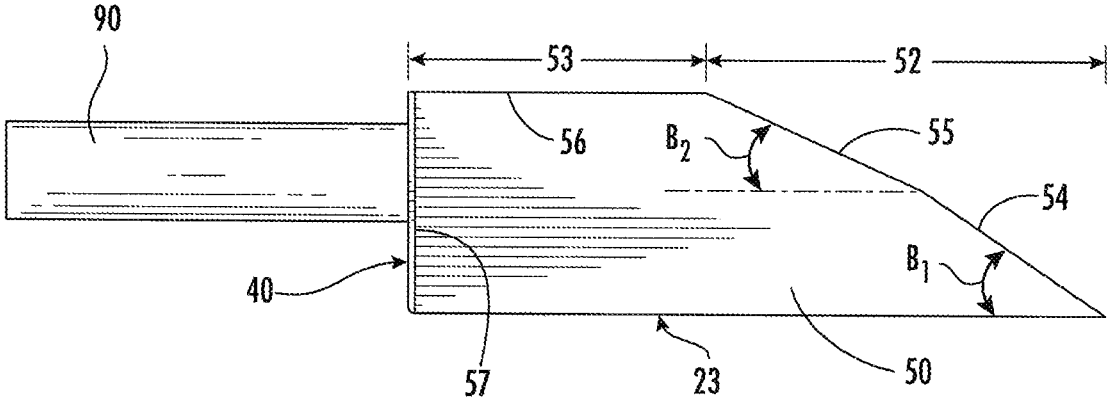
FIG. 5B is right side view of a preferred embodiment for the present invention.
Figure 6:
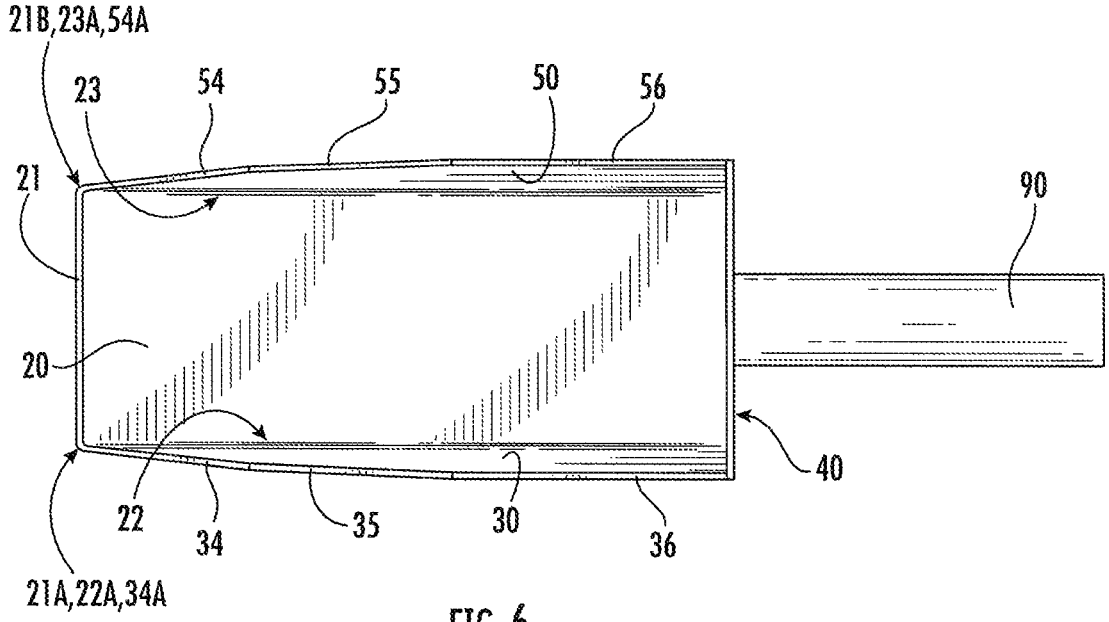
FIG. 6 is a top plan view of a preferred embodiment for the present invention.
Figure 7:
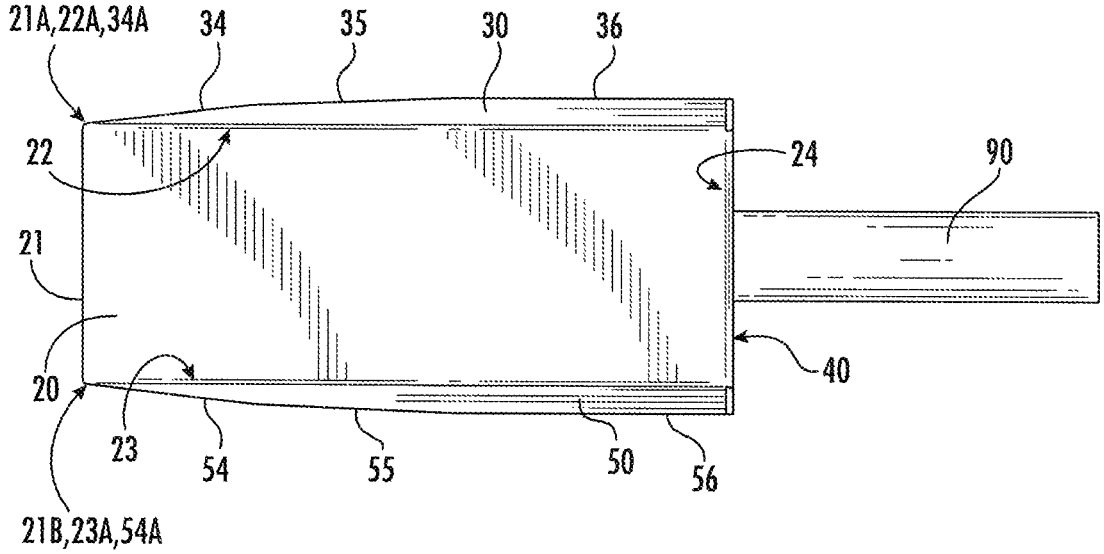
FIG. 7 is a bottom plan view of a preferred embodiment for the present invention.
Figure 8:
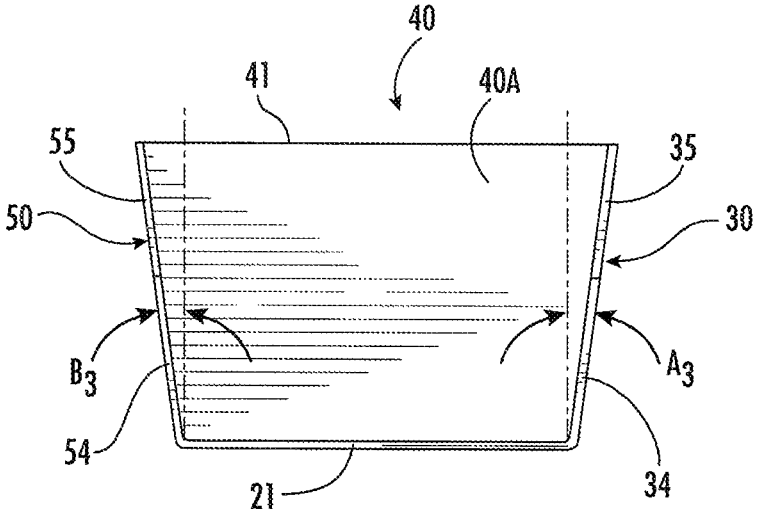
FIG. 8 is a front view of a preferred embodiment for the present invention.

Referring to FIGS. 1 to 11, and specifically to FIGS. 6, and 7, the rectangular bottom 20 of one preferred embodiment of the present invention 10 comprises a beveled front edge 21 having a first beveled end 21A and a second beveled end 21B, a first bottom edge 22 having a first bottom edge first end 22A and a first bottom edge second end 22B, a second bottom edge 23 having a second bottom edge first end 23A and a second bottom edge second end 23B, and a rear bottom edge 24 having a rear bottom edge first end 24A and a rear bottom edge second end 24B. The beveled front edge 21 having a beveled front edge length of about 2½ inches, the first bottom edge 22 having a first bottom edge length of about 7 inches, the second bottom edge 23 having a second bottom edge length of about 7 inches, and the rear bottom edge 24 having a rear bottom edge length of about 2½ inches. In a preferred embodiment of the present invention the beveled front edge 21 provides a smooth transition for debris entering into the confines of the present invention as the subject gutter cleaning device is pushed along the bottom wall of a gutter and also facilitates the dislodging of debris that may has compacted or dried within the gutter.

Now referring specifically to FIGS. 1, 2, 3, 8, and 11, the first angular side wall 30 for one preferred embodiment of the present invention extends contiguously upward at a first outward angle A3 of about 7 degrees from the first bottom edge 22 of said rectangular bottom 20 defining a first top edge 31 and a first rear edge 37. Since the first angular side wall 30 generally compliments the angle of a gutter's interior wall, there is a greater likelihood that debris which is adjacent to, or clinging to, a gutter's interior wall will be received into the confines of the present invention as a user pushes the present invention within the gutter to remove debris. As illustrated in FIG. 5A, the first angular side wall 30 includes a first front sloped portion 32 and a first rear rectangular portion 33. The first top edge 31 comprises a first sloped upper edge 34, a second sloped upper edge 35, and a first horizontal upper edge 36.

In a preferred embodiment of the present invention the first sloped upper edge 34 of the first top edge 31 having a first sloped upper edge first end 34A contiguous to the first beveled end 21A and a first sloped upper edge second end 34B. As illustrated in FIG. 5A, the first sloped upper edge 34 having a first upward angle A1 of about 35 degrees and extends upward a first length of about 2¼ inches from the first beveled end 21A of the beveled front edge 21 of the rectangular bottom 20 to the first sloped upper edge second end 34B.

Continuing to refer to FIGS. 1, 2, 3, 8, and 11, the second sloped upper edge 35 of the first top edge 31 for one preferred embodiment of the present invention having a second sloped upper edge first end 35A contiguous to the first sloped upper edge second end 34B and a second sloped upper edge second end 35B. As illustrated in FIG. 5A, the second sloped upper edge 35 having a second upward angle A2 of about 25 degrees and extends upward a second length of about 2⅜ inches contiguously from the first sloped upper edge second end 34B to the second sloped upper edge second end 35B. The respective aspects of the first and second sloped upper edges 34, 35 of the first angular sidewall 30 provide a user the ability to rotate the present invention 10 in the direction of the first angular side wall such that either the first sloped upper edge or the second sloped upper edge generally matches the angle of a gutter's interior wall to better receive debris that is adjacent, or attached, to a gutter's interior wall.

Figure 2:
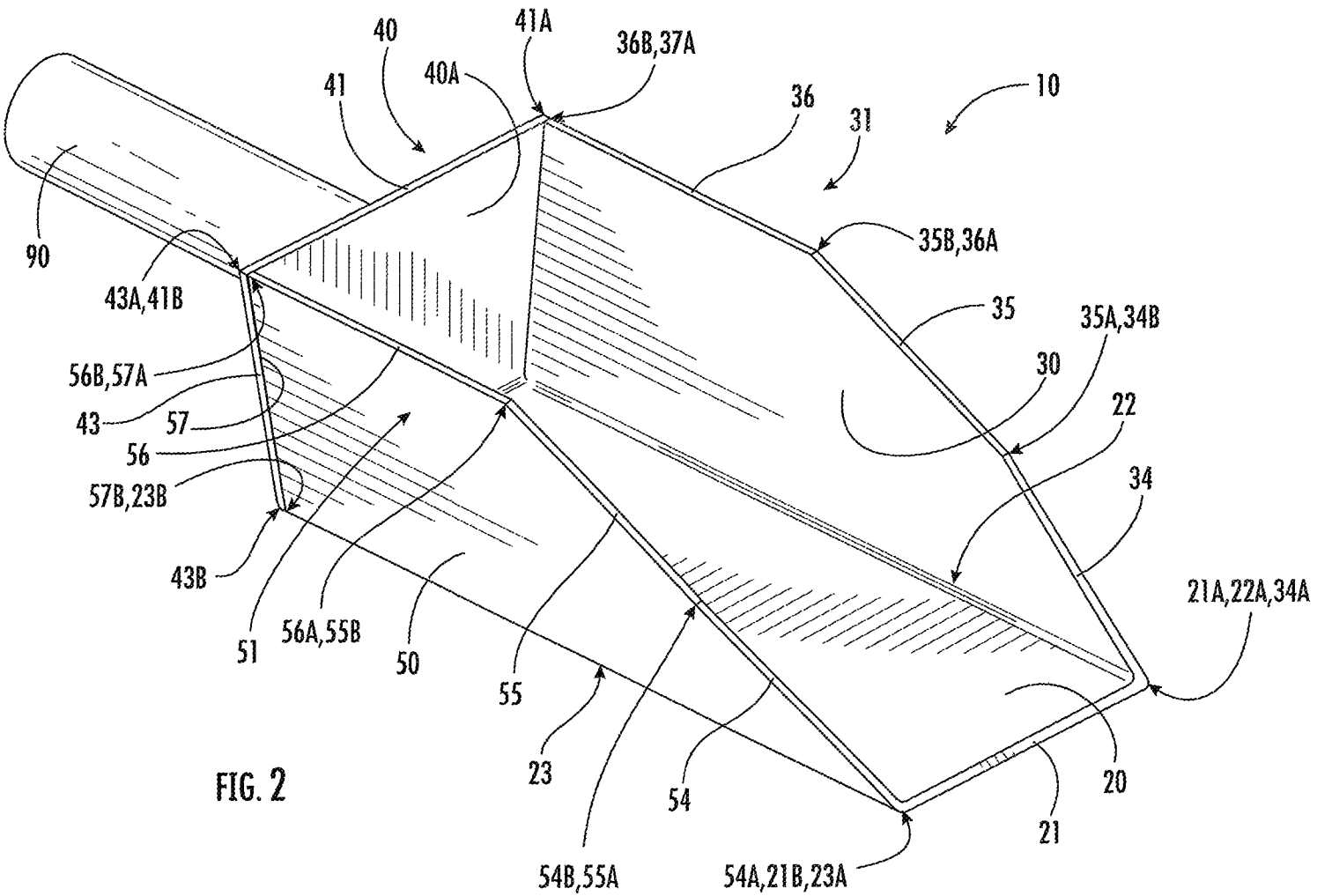
FIG. 2 is a front right perspective view of a preferred embodiment for the present invention.
Figure 3:
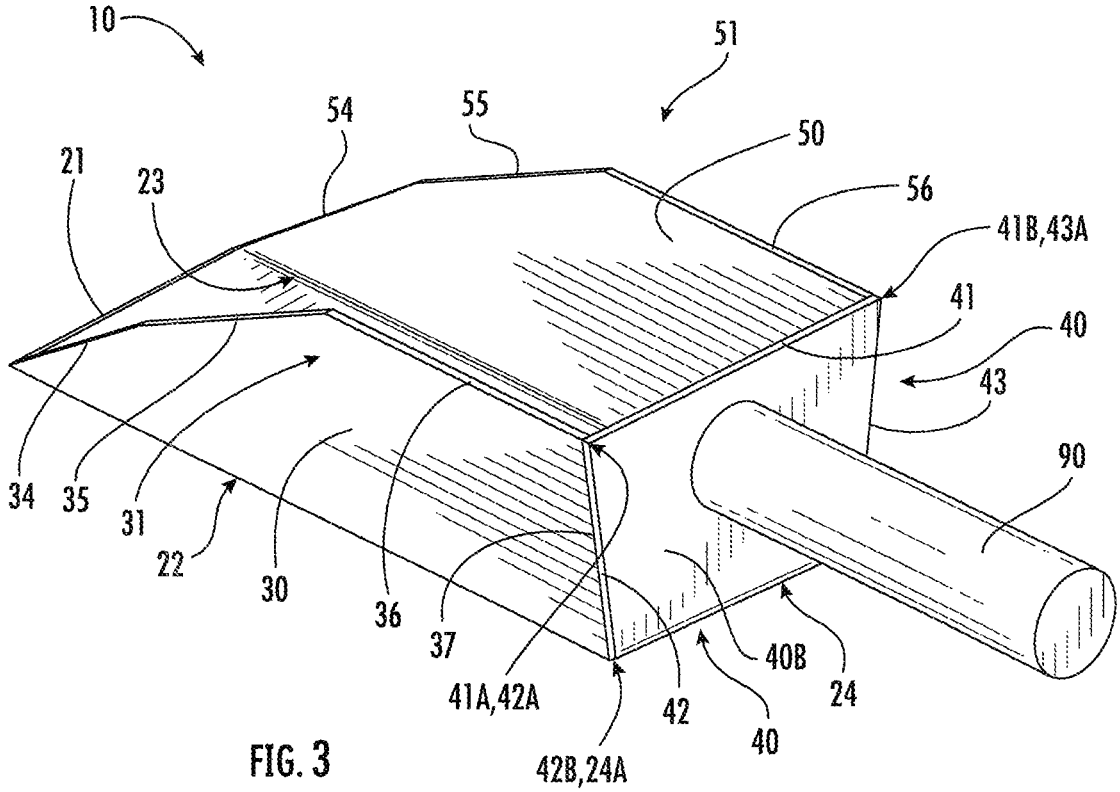
FIG. 3 is a rear left perspective view of a preferred embodiment for the present invention.
Figure 4:
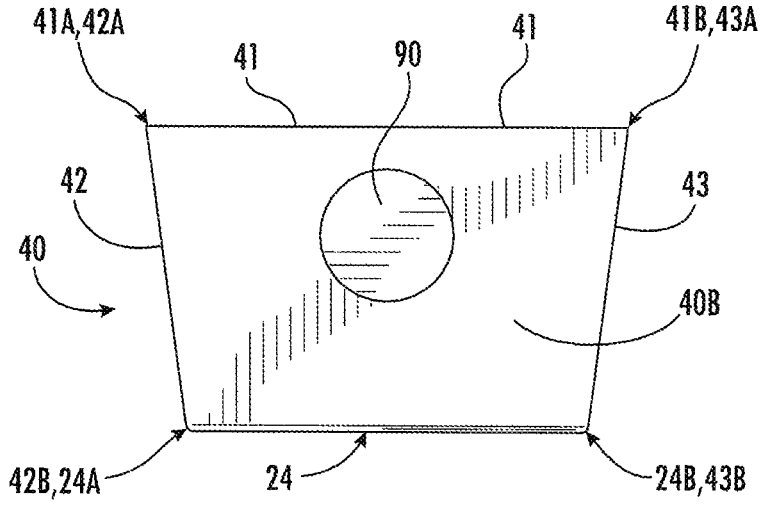
FIG. 4 is a rear view of a preferred embodiment for the present invention.

As shown in FIGS. 1, 2, and 3, the first horizontal upper edge 36 of the first top edge 31 for one preferred embodiment of the present invention 10 having a first horizontal upper edge first end 36A contiguous to the second sloped upper edge second end 35B and a first horizontal upper edge second end 36B. The first horizontal upper edge 36 extends a first horizontal length of about 3 inches contiguously from the second sloped upper edge second end 35B to the first horizontal upper edge second end 36B. The first horizontal upper edge 36 being parallel to the first bottom edge 22 of the rectangular bottom 20.

The first rear edge 37 of the first angular side wall 30 for one preferred embodiment of the present invention having a first rear edge upper end 37A contiguous to the first horizontal upper edge second end 36B and a first rear edge lower end 37B contiguous to the first bottom edge second end 22B. The first rear edge extending a first rear edge length of about 2⁵⁄₁₆ inches perpendicularly downward from the first horizontal upper edge second end 36B to the first rear edge lower end 37B.

Now referring specifically to FIGS. 1, 2, 3, 8, and 11, the second angular side wall 50 for one preferred embodiment of the present invention 10 extends contiguously upward at a second outward angle B3 of about 7 degrees from the second bottom edge 23 of said rectangular bottom 20 defining a second top edge 51 and a second rear edge 57. In the same manner as discussed above for the first angular side wall 30 the second angular side wall 50 generally compliments the angle of a gutter's interior wall, as such there is a greater likelihood that debris which is adjacent to, or clinging to, a gutter's interior wall will be received into the confines of the present invention as a user pushes the present invention within the gutter walls to remove debris. Additionally, the outward angle of the first and second angular side walls of the present invention tend to compress debris within the confines of the present invention which helps to prevent the debris from becoming dislodged and falling back into the gutter interior as the present invention is removed from the gutter. As illustrated in FIG. 5B, the second angular side wall 50 includes a second front sloped portion 52 and a second rear rectangular portion 53. The second top edge 51 comprises a third sloped upper edge 54, a fourth sloped upper edge 55, and a second horizontal upper edge 56.

In a preferred embodiment for the present invention the third sloped upper edge 54 of the second top edge 51 having a third sloped upper edge first end 54A contiguous to the second beveled end 21B and a third sloped upper edge second end 54B. The third sloped upper edge 54 having a third upward angle B1 of about 35 degrees as illustrated in FIG. 5B and extends upward a third length of about 2 ¼ inches from the second beveled end 21B of the beveled front edge 21 of the rectangular bottom 20 to the third sloped upper edge second end 54B.

Continuing to refer to FIGS. 1, 2, 3, 8, and 11, the fourth sloped upper edge 55 of the second top edge 51 for one preferred embodiment of the present invention having a fourth sloped upper edge first end 55A contiguous to the third sloped upper edge second end 54B and a fourth sloped upper edge second end 55B. The fourth sloped upper edge 55 having a fourth upward angle B2 of about 25 degrees as illustrated in FIG. 5B and extends upward a fourth length of about 2⅜ inches contiguously from the third sloped upper edge second end 54B to the fourth sloped upper edge second end 55B. As provided above regarding the respective aspects of the first and second sloped upper edges 34, 35 for the first angular side wall 30, the third and fourth sloped upper edges 54, 55 of the second angular sidewall 50 provide a user the ability to rotate the present invention in the direction of the second angular side wall such that either the third sloped upper edge or the fourth sloped upper edge generally matches the angle of a gutter's interior wall to better receive debris that is adjacent, or attached, to a gutter's interior wall.

As shown in FIGS. 1, 2, and 3, the second horizontal upper edge 56 of the second top edge 51 for one preferred embodiment of the present invention 10 having a second horizontal upper edge first end 56A contiguous to the fourth sloped upper edge second end 55B and a second horizontal upper edge second end 56B. The second horizontal upper edge extends a second horizontal length of about 3 inches contiguously from the fourth sloped upper edge second end 55B to the second horizontal upper edge second end 56B. The second horizontal upper edge 56 being parallel to the second bottom edge 23 of said rectangular bottom 20.

The second rear edge 57 of the second angular side wall 50 for one preferred embodiment of the present invention having a second rear edge upper end 57A contiguous to the second horizontal upper edge second end 56B and a second rear edge lower end 57B contiguous to the second bottom edge second end 23B. The second rear edge 57 extending a second rear edge length of about 2⁵⁄₁₆ inches perpendicularly downward from the second horizontal upper edge second end 56B to the second rear edge lower end 57B. The short lengths of the first and second rear edges 37, 57 for the respective first and second angular side walls 30, 50 result in the present invention having a relatively low height which facilitates the entry and removal of the present invention into the gutter interior space and also increases the maneuverability of the present invention within the constricted confines of a gutter.

Now referring to FIGS. 1, 2, 3, 4, 6, 7, 8, and 9, the vertical trapezoidal rear wall 40 of one preferred embodiment of the present invention 10 being contiguous to the rear bottom edge 24 of the rectangular bottom 20 and extending perpendicularly upward from the rear bottom edge 24 of the rectangular bottom 20. The vertical trapezoidal rear wall 40 having a rear wall height of about 2¼ inches and comprising inner and outer surfaces 40A, 40B, a rear top edge 41, a first angled edge 42, and a second angled edge 43.

The rear top edge 41 of the vertical trapezoidal rear wall having a rear top edge first end 41A, and a rear top edge second end 41B. The rear top edge 41 having rear top edge length of about 3 inches.

Figure 9:
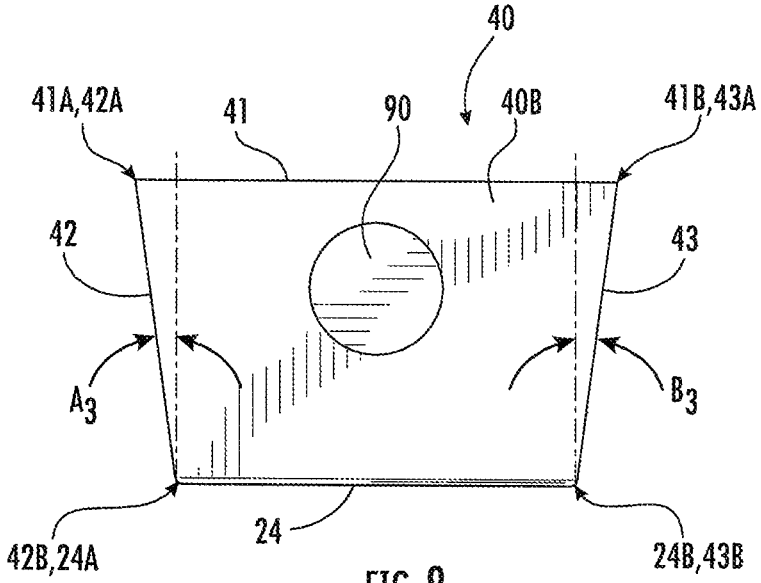
FIG. 9 is a rear view of a preferred embodiment for the present invention.
Figure 10:
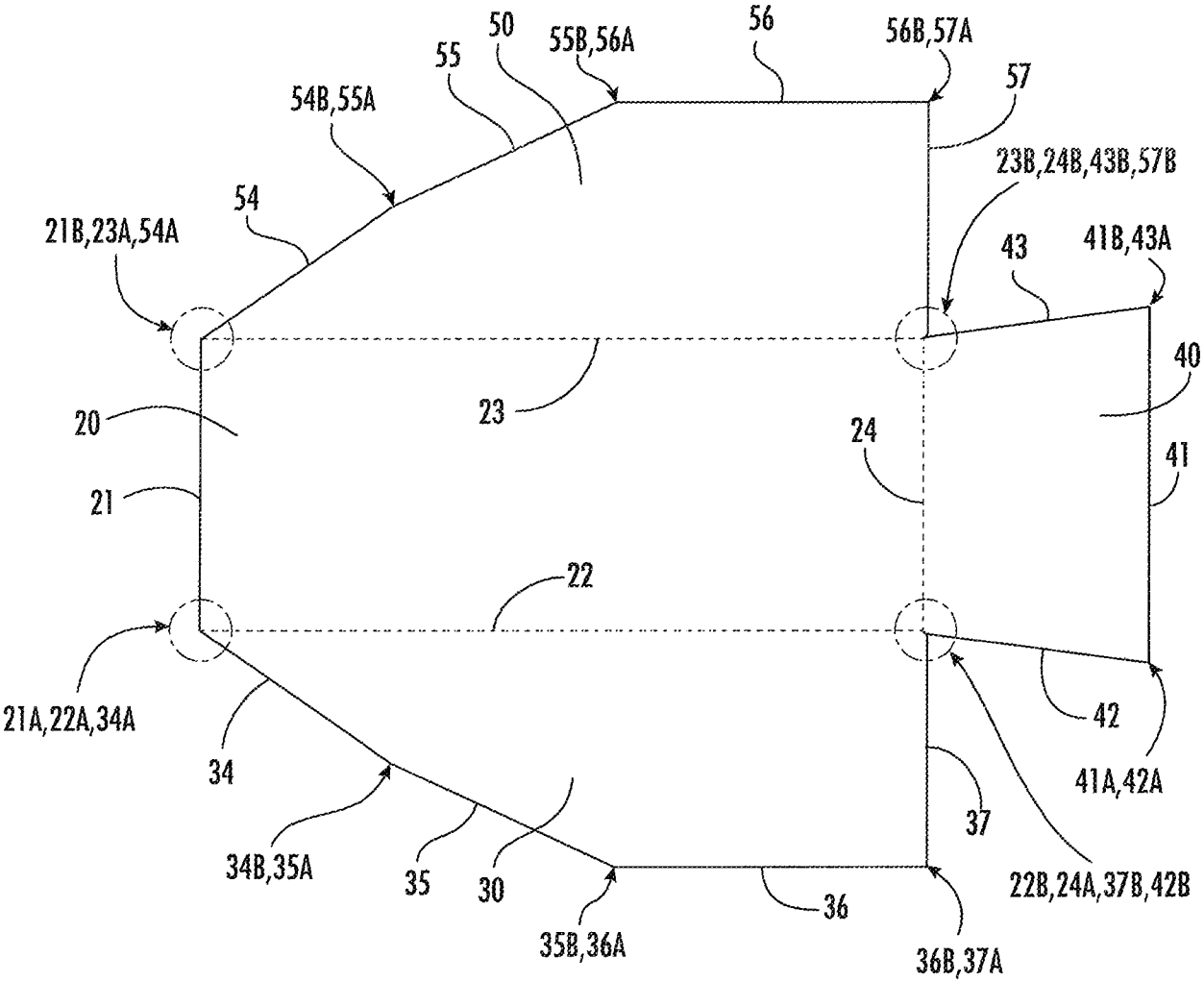
FIG. 10 is a template for manufacturing a preferred embodiment of the present invention.
Figure 11:
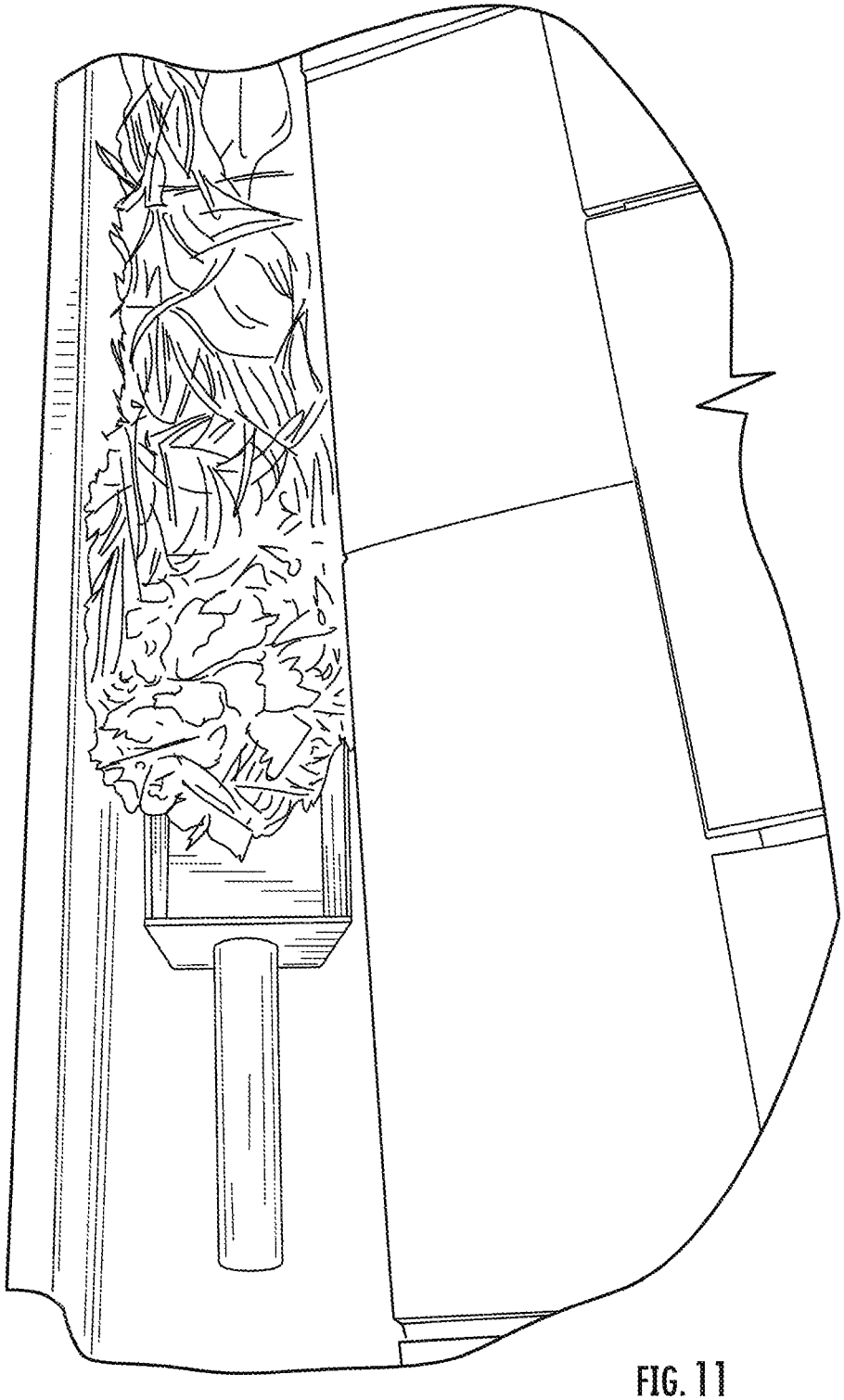
FIG. 11 is an environmental view illustrating the present invention positioned within a gutter for the removal accumulated debris.

The first angled edge 42 of the vertical trapezoidal rear wall 40 having a first angled edge upper end 42A contiguous to the rear top edge first end 41A and a first angled edge lower end 42B contiguous to the rear bottom edge first end 24A. The first angled edge 42 extends a length of about 2⁵⁄₁₆ inches upward at the first outward angle A3 of about 7 degrees, as illustrated in FIG. 9, from the rear bottom edge first end 24A of said rectangular bottom 20 to the first angled edge upper end 42A. In one preferred embodiment of the present invention upon completion of manufacture of the present invention the first rear edge 37 of said first angular side wall 30 abuts, and is affixed generally by spot welding to, that inner surface 40A of the vertical trapezoidal rear wall 40 which is adjacent to the first angled edge 42 of the vertical trapezoidal rear wall 40.

The second angled edge 43 of the vertical trapezoidal rear wall having a second angled edge upper end 43A contiguous to the rear top edge second end 41B and a second angled edge lower end 43B contiguous to the rear bottom edge second end 24B. The second angled edge 43 extending a length of about 2⁵⁄₁₆ inches upward at the second outward angle B3 of about 7 degrees, as illustrated in FIG. 9, from the rear bottom edge second end 24B of said rectangular bottom 20 to the second angled edge upper end 43A. In one preferred embodiment of the present invention upon completion of manufacture of the present invention the second rear edge 57 of the second angular side wall 50 abuts, and is affixed generally by spot welding to, that inner surface 40A of the vertical trapezoidal rear wall 40 which is adjacent to the second angled edge 43 of the vertical trapezoidal rear wall 40, Now referring to FIGS. 1, 2, 3, 4, SA, SB, 6, 7, 9, and 11, the elongated tubular handle 90 of one preferred embodiment of the present invention 10 being attached centrally upward to the outer surface 40B of the vertical trapezoidal rear wall 40 and extends horizontally outward from the outer surface 40B of the vertical trapezoidal rear wall 40. In such preferred embodiment the center of the elongated tubular handle being centrally position at a height of about 1½ inches on center above the rear bottom edge 24 of the rectangular bottom 20 of the present invention and centered between the first and second angled edges 42,43 of the vertical trapezoidal rear wall 40. The position and length of the elongated tubular handle aids in the maneuverability of the present invention within the narrow confines of a gutter and also places a user's hand in a relatively safe raised position behind the present invention during use between the walls of a gutter. The elongated tubular handle 90 having a tubular handle diameter of about 1 inch and an elongated tubular handle length of about 5 inches. The elongated tubular handle of the present invention is attached to the outer surface of the vertical trapezoidal rear wall by spot welding, or such other means that provides a secure attachment, and may be manufactured in a hollow tubular configuration or as a solid metal handle.

In at least one preferred embodiment of the present invention, a device for cleaning gutters, the unique aspects associated with the size and configuration of components for the present invention, such as but not limited to the angles and lengths disclosed herein for the walls and edges of the present invention, provide a user to the ability to effectively remove debris of various kinds which has accumulated within a gutter.

When using a preferred embodiment of the present invention the overall shape and dimensions of the present invention enables a user to position and maneuver the present invention within the relative tight confines of gutters commonly used to direct the flow of rainwater away from a building. The design and configuration of the present invention also allows a user to maneuver the subject gutter cleaning device around gutter fasteners, gutter braces, and shingle overhang for more effective removal of debris and to avoid injury to hands and fingers when pushing the present invention within and against the gutter walls to collect and remove debris that has accumulated within the gutter. Additionally, the centrally upward position of the elongated tubular handle attached to the outer surface of the vertical trapezoidal rear wall of the present invention provides a means for producing leverage to raise the beveled front edge of the subject gutter cleaning device when removing debris from within a gutter while simultaneously keeping the user's hand in a raised position out of harm's way within the gutter.

During use a preferred embodiment of the present invention is generally pushed within a gutter's interior walls along the gutter's bottom surface. The first and second angular side walls 30, 50 of the present invention having respective first and second outward angles A3, B3, of about 7 degrees are designed and configured to generally compliment the angle of a gutter's interior walls. This aspect of one preferred embodiment of the present invention increases its ability to effectively receive debris into the confines of the present invention for removing debris from a gutter. An additional aspect of the first and second angular side walls in a preferred embodiment of the present invention is the compression of the debris as it is pushed and received into the confines of the present invention during use. The compression of the debris minimizes the likelihood of the debris becoming dislodged and spilling back into the gutter as the present invention and the debris contained therein is removed from the gutter.

In a preferred embodiment of the present invention the first angular side wall 30 is comprised of the first top edge 31 and the second angular side wall 50 is comprised of the second top edge 51. The first top edge 31 of the first angular side wall 30 includes the first and second sloped upper edges 34, 35 and the second top edge 51 of the second angular side wall 50 includes the third and fourth sloped upper edges 54, 55. Both the first sloped upper edge 34 of the first angular side wall 30 and the third sloped upper edge 54 of the second angular side wall 50 have respective first and third upward angles A1, B1 of about 35 degrees and respective first and third lengths of about 2⅝ inches. Additionally, both the second sloped upper edge 35 of the first angular side wall 30 and the fourth sloped upper edge 55 of the second angular side wall 50 have respective second and fourth upward angles A2, B2 of about 25 degrees and respective second and fourth lengths of about 2⅜ inches. The angles and lengths of the first and second sloped upper edges of the first angular side wall, and also the angles and lengths of the third and fourth sloped upper edges of the second angular side wall, are unique aspects of the present invention that provide a user the ability to rotate the present invention within a gutter's interior walls such that one of the subject sloped upper edges can better engage the interior angle of a gutter for a more effective removal of debris accumulated along a gutter wall.

On certain occasions the accumulated debris may become compacted and/or dried within a gutter's interior walls. The beveled front edge of the rectangular bottom of one preferred embodiment of the present invention many be used in a scrapping or chiseling fashion to dislodge such compacted and/or dried debris for removal.

In one preferred embodiment of the present invention, a device for cleaning gutters, such device is manually manufactured preferably from aluminum sheet metal template pattern having a thickness of about 14 gauge. Now referring to FIG. 10, the template is deformed via a series of bends along the appropriate edges of the rectangular bottom of the present invention. The first angular side wall 30 having a first outward angle of about 7 degrees is created via a bend along the first bottom edge 22 of the rectangular bottom 20 of the present invention, the second angular side wall 50 having a second outward angle of about 7 degrees is created via a bend along the second bottom edge 23 of the rectangular bottom 20 of the present invention, and the vertical trapezoidal rear wall 40 is perpendicularly created via a bend along the rear bottom edge 24 of the rectangular bottom 20 of the present invention. Subsequently, the first rear edge 37 of the first angular side wall 30 is spot welded to that inner surface 40A of the vertical trapezoidal rear wall 40 being adjacent to the first angled edge 42 of the vertical trapezoidal rear wall 40. Similarly, the second rear edge 57 of the second angular side wall 30 is spot welded to that inner surface 40A of the vertical trapezoidal rear wall 40 being adjacent to the second angled edge 42 of the vertical trapezoidal rear wall 40. Finally, the elongated tubular handle 90 of the present invention is attached to the outer surface of the vertical trapezoidal rear wall by spot welding, or such other means that provides a secure attachment, and may be manufactured in a hollow tubular configuration or as a solid metal handle.

In another preferred embodiment of the present invention is mechanically manufactured from a length, or lengths, of sheet metal via a sheet metal forming process utilizing punches and/or dies and sheet metal presses wherein a plurality of gutter cleaning device templates are stamped or cut pursuant to a pattern for the present invention from the length, or lengths, of sheet metal. The template is deformed via a sheet forming press which mechanically creates the required angular bends along the appropriate edges by which the first angular side wall 30 having a first outward angle of about 7 degrees is created along the first bottom edge 22 of the rectangular bottom 20 of the present invention, the second angular side wall 50 having a second outward angle of about 7 degrees is created along the second bottom edge 23 of the rectangular bottom 20 of the present invention, and the vertical trapezoidal rear wall 40 is perpendicularly created along the rear bottom edge 24 of the rectangular bottom 20 of the present invention. Subsequently, the first rear edge of the first angular side wall 30 is spot welded to that inner surface 40A of the vertical trapezoidal rear wall 40 being adjacent to the first angled edge 42 of the vertical trapezoidal rear wall 40. Similarly, the second rear edge of the second angular side wall 30 is spot welded to that inner surface 40A of the vertical trapezoidal rear wall 40 being adjacent to the second angled edge 42 of the vertical trapezoidal rear wall 40. Similarly to the manually manufactured present invention, the elongated tubular handle 90 of the present invention that is mechanically manufactured is attached to the outer surface of the vertical trapezoidal rear wall by spot welding, or such other means that provides a secure attachment, and may be manufactured in a hollow tubular configuration or as a solid metal handle. The kind of sheet metal from which the present invention is mechanically manufactured includes aluminum, steel, or tin having a gauge thickness as may be suitable for such sheet metal when used with the sheet metal forming process.

Although preferred embodiments of the present invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged either in whole, or in part. Therefore, the spirit and scope of the invention should not be limited to the description of the preferred embodiments contained herein.

What is claimed is:

1. A device for cleaning gutters comprising:

a rectangular bottom comprising a beveled front edge having a first beveled end, a second beveled end, and a beveled front edge length, a first bottom edge having a first bottom edge first end, a first bottom edge second end, and a first bottom edge length, a second bottom edge having a second bottom edge first end, a second bottom edge second end, and a second bottom edge length, and a rear bottom edge having a rear bottom edge first end, a rear bottom edge second end, and a rear bottom edge length, wherein said first beveled end being contiguous to said first bottom edge first end, said first bottom edge second end being contiguous to said rear bottom edge first end, said rear bottom edge second end being contiguous to said second bottom edge second end, and said second bottom edge first end being contiguous to said second beveled end;

a first angular side wall extending contiguously upward at a first outward angle from said first bottom edge of said rectangular bottom defining a first top edge and a first rear edge, said first angular side wall having a first front sloped portion and a first rear rectangular portion, said first top edge of said first angular side wall comprising a first sloped upper edge having a first sloped upper edge first end being contiguous to said first beveled end and to said first bottom edge first end and a first sloped upper edge second end, wherein said first sloped upper edge having a first upward angle and a first length extending upward from said first beveled end of said beveled front edge of said rectangular bottom to said first sloped upper edge second end, a second sloped upper edge having a second sloped upper edge first end being contiguous to said first sloped upper edge second end and a second sloped upper edge second end, wherein said second sloped upper edge having a second upward angle and a second length extending upward contiguously from said first sloped upper edge second end to said second sloped upper edge second end, and a first horizontal upper edge having a first horizontal upper edge first end being contiguous to said second sloped upper edge second end and a first horizontal upper edge second end, wherein said first horizontal upper edge having a first horizontal length extending contiguously from said second sloped upper edge second end to said first horizontal upper edge second end, said first horizontal upper edge being parallel to said first bottom edge of said rectangular bottom, and said first rear edge of said first angular side wall having a first rear edge upper end being contiguous to said first horizontal upper edge second end and a first rear edge lower end being contiguous to said first bottom edge second end, wherein said first rear edge having a first rear edge length extending perpendicularly downward from said first horizontal upper edge second end to said first rear edge lower end;

a second angular side wall extending contiguously upward at a second outward angle from said second bottom edge of said rectangular bottom defining a second top edge and a second rear edge, said second angular side wall having a second front sloped portion and a second rear rectangular portion, said second top edge of said second angular side wall comprising a third sloped upper edge having a third sloped upper edge first end being contiguous to said second beveled end and to said second bottom edge first end and a third sloped upper edge second end, wherein said third sloped upper edge having a third upward angle and a third length extending upward from said second beveled end of said beveled front edge of said rectangular bottom to said third sloped upper edge second end, a fourth sloped upper edge having a fourth sloped upper edge first end being contiguous to said third sloped upper edge second end and a fourth sloped upper edge second end, wherein said fourth sloped upper edge having a fourth upward angle and a fourth length extending upward contiguously from said third sloped upper edge second end to said fourth sloped upper edge second end, and a second horizontal upper edge having a second horizontal upper edge first end being contiguous to said fourth sloped upper edge second end and a second horizontal upper edge second end, wherein said second horizontal upper edge having a second horizontal length extending contiguously from said fourth sloped upper edge second end to said second horizontal upper edge second end, said second horizontal upper edge being parallel to said second bottom edge of said rectangular bottom, said second rear edge of said second angular side wall having a second rear edge upper end being contiguous to said second horizontal upper edge second end and a second rear edge lower end being contiguous to said second bottom edge second end, wherein said second rear edge having a second rear edge length extending perpendicularly downward from said second horizontal upper edge second end to said second rear edge lower end;

a vertical trapezoidal rear wall having a rear wall height and extending contiguously perpendicularly upward from said rear bottom edge of said rectangular bottom, said vertical trapezoidal rear wall comprising inner and outer surfaces, a rear top edge having a rear top edge first end, a rear top edge second end, and a rear top edge length, a first angled edge having a first angled edge upper end being contiguous to said rear top edge first end and a first angled edge lower end being contiguous to said rear bottom edge first end, said first angled edge having a first angled edge length extending upward at said first outward angle from said rear bottom edge first end of said rectangular bottom to said first angled edge upper end, and a second angled edge having a second angled edge upper end being contiguous to said rear top edge second end and a second angled edge lower end being contiguous to said rear bottom edge second end, said second angled edge having a second angled edge length extending upward at said second outward angle from said rear bottom edge second end of said rectangular bottom to said second angled edge upper end, wherein said first rear edge of said first angular side wall abuts said inner surface of said vertical trapezoidal rear wall at and being adjacent to said first angled edge of said vertical trapezoidal rear wall, and wherein said second rear edge of said second angular side wall abuts said inner surface of said vertical trapezoidal rear wall at and being adjacent to said second angled edge of said vertical trapezoidal rear wall; and an elongated tubular handle centrally upward attached to said outer surface of said vertical trapezoidal rear wall and extending horizontally outwardly away from said vertical trapezoidal rear wall, wherein said first beveled end, said first bottom edge first end, and said first sloped upper edge first end each being contiguous to the other, wherein said second beveled end, said second bottom edge first end, and said third sloped upper edge first end each being contiguous to the other, wherein said first bottom edge second end, said rear bottom edge first end, said first rear edge lower end, and said first angled edge lower end each being contiguous to the other, and wherein said second bottom edge second end, said rear bottom edge second end, said second rear edge lower end, and said second angled edge lower end each being contiguous to the other.

2. The device for cleaning gutters of claim 1, wherein both of said beveled front edge length of said beveled front edge and said rear bottom edge length of said rear bottom edge being about 2½ inches.

3. The device for cleaning gutters of claim 1, wherein both of said first bottom edge length of said first bottom edge and said second bottom edge length of said second bottom edge being about 7 inches.

4. The device for cleaning gutters of claim 1, wherein both of said first length of said first sloped upper edge and said third length of said third sloped upper edge being about 2¼ inches.

5. The device for cleaning gutters of claim 1, wherein both of said second length of said second sloped upper edge and said fourth length of said fourth sloped upper edge being about 2⅜ inches.

6. The device for cleaning gutters of claim 1, wherein both of said first horizontal length of said first horizontal upper edge and said second horizontal length of said second horizontal upper edge being about 3 inches.

7. The device for cleaning gutters of claim 1, wherein each of said first rear edge length of said first rear edge, said second rear edge length of said second rear edge, said first angled edge length of said first angled edge, and said second angled edge length of said second angled edge all being about 2 15/16 inches.

8. The device for cleaning gutters of claim 1, wherein said rear wall height of said vertical trapezoidal rear wall being about 2¼ inches.

9. The device for cleaning gutters of claim 1, wherein said rear top edge length of said rear top edge being about 3 inches.

10. The device for cleaning gutters of claim 1, wherein said elongated tubular handle having a tubular handle length of about 5 inches and a tubular handle diameter of about 1 inch.

11. The device for cleaning gutters of claim 1, wherein both of said first outward angle and said second outward angle being about 7 degrees.

12. The device for cleaning gutters of claim 1, wherein both of said first upward angle and said third upward angle being about 35 degrees.

13. The device for cleaning gutters of claim 1, wherein both of said second upward angle and said fourth upward angle being about 25 degrees.

14. The device for cleaning gutters of claim 1, wherein said device for cleaning gutters is manufactured from sheet metals comprising aluminum, steel, and tin.

15. A device for cleaning gutters comprising:

a rectangular bottom comprising a beveled front edge having a first beveled end, a second beveled end, and a beveled front edge length of about 2½ inches, a first bottom edge having a first bottom edge first end, a first bottom edge second end, and a first bottom edge length of about 7 inches, a second bottom edge having a second bottom edge first end, a second bottom edge second end, and a second bottom edge length of about 7 inches, and a rear bottom edge having a rear bottom edge first end, a rear bottom edge second end; and a rear bottom edge length of about 2½ inches, wherein said first beveled end being contiguous to said first bottom edge first end, said first bottom edge second end being contiguous to said rear bottom edge first end, said rear bottom edge second end being contiguous to said second bottom edge second end, and said second bottom edge first end being contiguous to said second beveled end;

a first angular side wall extending contiguously upward at a first outward angle of about 7 degrees from said first bottom edge of said rectangular bottom defining a first top edge and a first rear edge, said first top edge of said first angular side wall comprising a first sloped upper edge being contiguous to said first beveled end and to said first bottom edge first end, wherein said first sloped upper edge having a first upward angle of about 35 degrees and a first length of about 2¼ inches extending upward from said first beveled end of said beveled front edge of said rectangular bottom, a second sloped upper edge being contiguous to said first sloped upper edge, wherein said second sloped upper edge having a second upward angle of about 25 degrees and a second length of about 2⅜ inches extending upward contiguously from said first sloped upper edge, and a first horizontal upper edge being contiguous to said second sloped upper edge, wherein said first horizontal upper edge having a first horizontal length of about 3 inches extending contiguously from said second sloped upper edge, said first horizontal upper edge being parallel to said first bottom edge of said rectangular bottom, and said first rear edge of said first angular side wall being contiguous to said first horizontal upper edge, wherein said first rear edge having a first rear edge length of about 2 5/16 inches extending perpendicularly downward from said first horizontal upper edge to said first bottom edge second end;

a second angular side wall extending contiguously upward at a second outward angle of about 7 degrees from said second bottom edge of said rectangular bottom defining a second top edge and a second rear edge, said second top edge of said second angular side wall comprising a third sloped upper edge being contiguous to said second beveled end and to said second bottom edge first end, wherein said third slope upper edge having a third upward angle of about 35 degrees and a third length of about 2¼ inches extending upward from said second beveled end of said beveled front edge of said rectangular bottom, a fourth sloped upper edge being contiguous to said third sloped upper edge, wherein said fourth sloped upper edge having a fourth upward angle of about 25 degrees and a fourth length of about 2⅜ inches extending upward contiguously from said third sloped upper edge, and a second horizontal upper edge being contiguous to said fourth sloped upper edge, wherein said second horizontal upper edge having a second horizontal length of about 3 inches extending contiguously from said fourth sloped upper edge, said second horizontal upper edge being parallel to said second bottom edge of said rectangular bottom, said second rear edge of said second angular side wall-being contiguous to said second horizontal upper edge, wherein said second rear edge having a second rear edge length of about 2⁵⁄₁₆ inches extending perpendicularly downward from said second horizontal upper edge to said second bottom edge second end;

a vertical trapezoidal rear wall extending contiguously perpendicularly upward from said rear bottom edge of said rectangular bottom having a rear wall height of about 2¼ inches, said vertical trapezoidal rear wall comprising inner and outer surfaces, a rear top edge having a rear top edge first end, a rear top edge second end, and a mar top edge length of about 3 inches, a first angled edge having a first angled edge upper end being contiguous to said rear top edge first end and a first angled edge lower end being contiguous to said rear bottom edge first end, said first angled edge having a first angled edge length of about 2⁵⁄₁₆ inches extending upward at said first outward angle of about 7 degrees from said rear bottom edge first end of said rectangular bottom to said first angled edge upper end, and a second angled edge having a second angled edge upper end being contiguous to said rear top edge second end and a second angled edge lower end being contiguous to said rear bottom edge second end, said second angled edge having a second angled edge length of about 2⁵⁄₁₆ inches extending upward at said second outward angle of about 7 degrees from said rear bottom edge second end of said rectangular bottom to said second angled edge upper end, wherein said first rear edge of said first angular side wall abuts said inner surface of said vertical trapezoidal rear wall at and being adjacent to said first angled edge of said vertical trapezoidal rear wall, and wherein said second rear edge of said second angular side wall abuts said inner surface of said vertical trapezoidal rear wall at and being adjacent to said second angled edge of said vertical trapezoidal rear wall; and an elongated tubular handle centrally upward attached to said outer surface of said vertical trapezoidal rear wall and extending horizontally outwardly away from said vertical trapezoidal rear wall, said elongated tubular handle having a tubular handle length of about 5 inches and a tubular handle diameter of about 1 inch.

* * * * *